US009107782B2

(12) United States Patent
Ermalovich

(10) Patent No.: US 9,107,782 B2
(45) **Date of Patent: *Aug. 18, 2015**

(54) ADJUSTABLE BED MATTRESS RETAINER SYSTEM

(71) Applicant: ERGOMOTION, INC., Santa Barbatra, CA (US)

(72) Inventor: Joseph Ermalovich, Santa Barbara, CA (US)

(73) Assignee: Ergomotion, Inc., Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/161,999

(22) Filed: Jan. 23, 2014

(65) Prior Publication Data

US 2014/0245536 A1 Sep. 4, 2014

Related U.S. Application Data

(60) Provisional application No. 61/756,297, filed on Jan. 24, 2013.

(51) Int. Cl.

| | |
|---|---|
| ***A47C 31/10*** | (2006.01) |
| ***A61G 7/002*** | (2006.01) |
| ***A47C 31/00*** | (2006.01) |
| ***A47C 31/12*** | (2006.01) |
| ***A47C 21/02*** | (2006.01) |
| ***A47C 20/04*** | (2006.01) |

(52) U.S. Cl.

CPC ..... *A61G 7/002* (2013.01); *A47C 20/04* (2013.01); *A47C 21/022* (2013.01); *A47C 21/026* (2013.01); *A47C 31/00* (2013.01); *A47C 31/105* (2013.01); *A47C 31/123* (2013.01)

(58) Field of Classification Search

CPC ..... A47C 21/022; A47C 31/02; A47C 31/10; A47C 31/11; A47C 31/105; A47C 31/123

USPC ..... 5/600, 658, 613, 617, 618, 402, 409, 5/411, 737, 482, 496, 498, 499, 504.1; 24/72.5

See application file for complete search history.

(56) References Cited

U.S. PATENT DOCUMENTS

| | | | | |
|---|---|---|---|---|
| 975,335 | A * | 11/1910 | Dial | 24/462 |
| 4,671,568 | A * | 6/1987 | Greer | 297/229 |
| 4,899,404 | A * | 2/1990 | Galumbeck | 5/616 |
| 5,644,811 | A * | 7/1997 | Cavazos | 5/738 |
| 7,810,194 | B2 * | 10/2010 | Clenet | 5/694 |
| 2003/0106157 | A1 * | 6/2003 | Rugset | 5/738 |
| 2004/0128762 | A1 * | 7/2004 | Weinman | 5/411 |
| 2005/0039265 | A1 * | 2/2005 | Gladney | 5/722 |
| 2005/0210587 | A1 * | 9/2005 | Piana et al. | 5/618 |
| 2010/0050339 | A1 * | 3/2010 | Beard et al. | 5/411 |
| 2011/0138533 | A1 * | 6/2011 | Rippe et al. | 5/499 |
| 2012/0167302 | A1 * | 7/2012 | Malouf et al. | 5/484 |
| 2013/0192001 | A1 * | 8/2013 | Rensink et al. | 5/691 |

* cited by examiner

*Primary Examiner* — Peter M Cuomo
*Assistant Examiner* — Myles Throop
(74) *Attorney, Agent, or Firm* — Felix L. Fischer

(57) ABSTRACT

A mattress retention system for adjustable beds employs a tubular fabric tension web attached with a restraining bar to a top surface of an element of an articulating support structure. The restraining bar is secured with brackets inset from a longitudinal edge and lateral edges of the articulating support structure element.

13 Claims, 7 Drawing Sheets

ADJUSTABLE BED MATTRESS RETAINER SYSTEM

REFERENCE TO RELATED APPLICATIONS

This application claims priority of U.S. provisional application Ser. No. 61/756,297 filed on Jan. 24, 2013 entitled ADJUSTABLE BED MATTRESS RETAINER SYSTEM The disclosure of which is incorporated herein by reference. This application is with U.S. application Ser. No. 13/367,616 filed on Feb. 7, 2012 entitled MATTRESS RETAINER SYSTEM FOR AN ADJUSTABLE BED the disclosure of which is incorporated herein by reference.

BACKGROUND

1. Field

This invention relates generally to the field of adjustable beds and more particularly to a structure incorporating a mating tension member extending from a support bar engaged on a surface of a mattress support element inset from an edge to the underside of the mattress adjacent a companion edge for tension the mattress to prevent "lift" in the mattress due to its rigidity when flexed by the articulating support elements.

2. Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

The mattress employed with an articulating bed is typically a dense foam construction for adequate support and comfort of the user. Due to the relative rigidity of the foam, when the bed is articulated the mattress tends to resist bending, at least to a degree, and rises from one or more support surfaces on the structure of the bed. This rising effect can be deleterious since relative support is lost beneath the elevated portion and addition of weight may cause a rapid shift in position which is undesirable. Additionally, accurate positioning of the bed is difficult since mattress position may shift.

Prior art articulating bed systems employ rigid frame elements extending from the bed support structure at the foot of the mattress to retain the mattress over the articulated frame as disclosed in copending U.S. patent application Ser. No. 12/154,509 filed on May 23, 2008 issued as U.S. Pat. No. 7,930,780 on Apr. 26, 2011 entitled ADJUSTABLE BED FRAME ASSEMBLY having a common assignee with the present invention. While effective in maintaining the longitudinal and lateral position of the mattress, these prior art devices may interfere with applying bedding to the mattress, particularly fitted sheets rendering making the bed somewhat difficult. Additionally, such retention devices may allow lateral motion of the mattress during change of articulated position.

It is therefore desirable to provide a retention system for the mattress on an articulating bed which restrains the mattress for longitudinal motion and allows easy make up of the bed with bedding including fitted sheets.

SUMMARY

The embodiments disclosed herein overcome the shortcomings of the prior art by providing a mattress retention system for adjustable beds using a tubular fabric tension web received over a retention bar attached to a top surface of an element of an articulating support structure. Brackets for bar attachment are inset from a longitudinal edge and lateral edges of the articulating support structure element. The tubular fabric tension web is attached to the bottom surface of a mattress adjacent an edge to be restrained.

In an example embodiment the tubular fabric tension web is stitched to a non-woven mattress cover adjacent a peripheral zipper surrounding the mattress edge.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1:
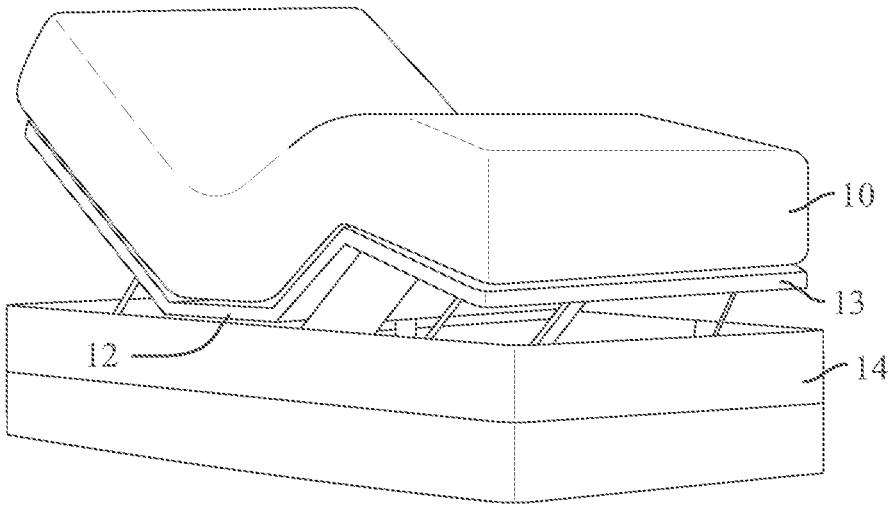
FIG. 1 is a top isometric view of an adjustable bed showing the mattress atop the support elements in an articulated position.

Embodiments shown in the drawings and described herein provide a mattress retention system for adjustable beds as shown in FIG. 1 wherein the mattress 10 rests atop an articulating support structure 12 extending from a support base 14. The articulating support structure 12 has multiple support sections adjustable to various angles including a foot support member 13.

Figure 2:
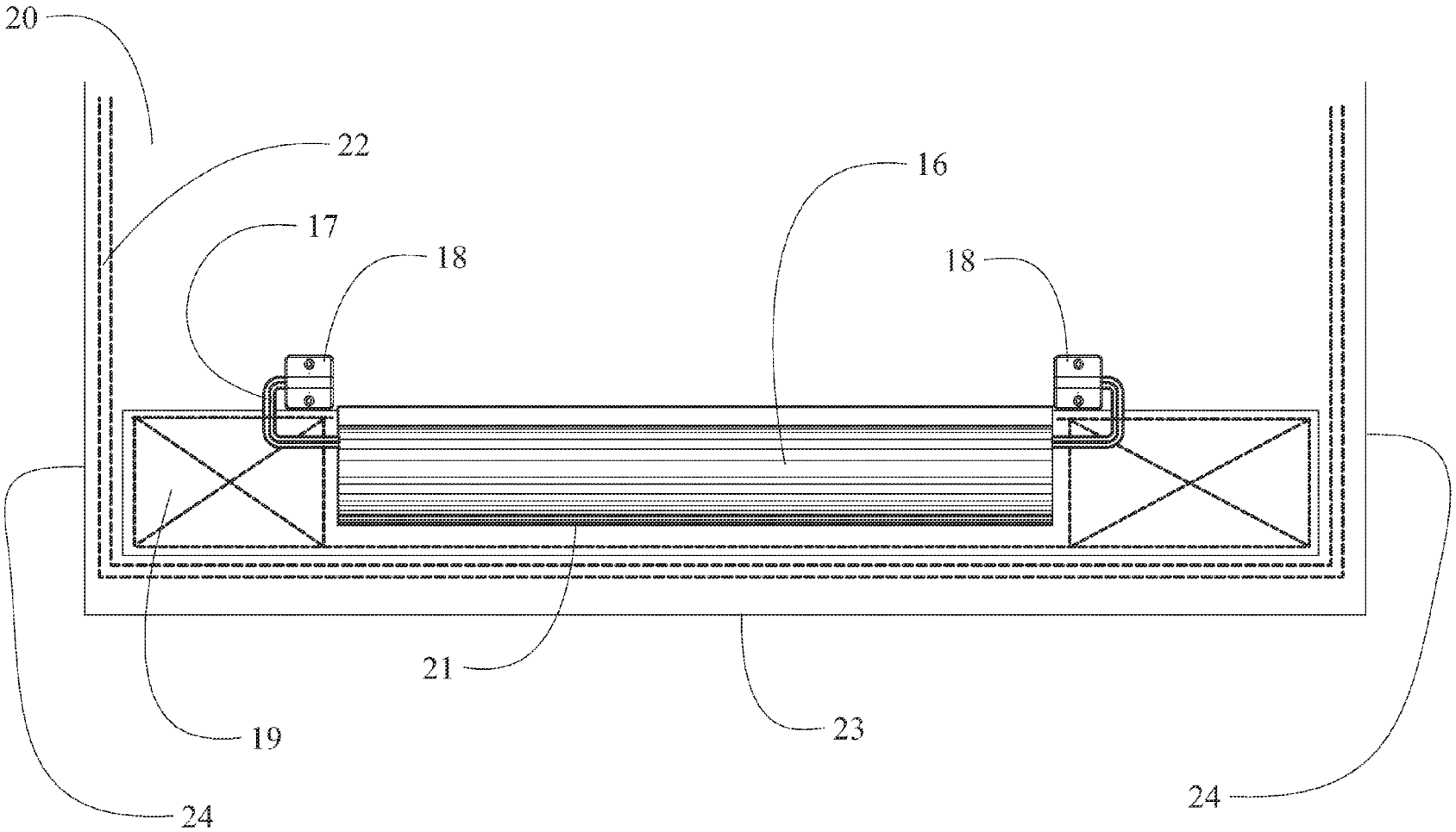
FIG. 2 is top view block diagram of the device shown with the mattress removed and the mattress cover transparent for clarity.

As shown in FIG. 2, a tubular fabric tension web 16 is received over a retaining bar 17 mounted to the top surface 15 of the foot support member 13 with a brackets 18. The tubular fabric tension web 16 is attached to a mattress cover 20 near a longitudinal edge of a zipper 22 which surrounds the mattress cover for inserting the mattress into the cover. For the embodiment shown, the mattress cover 20 is a non-woven fabric. A reinforced fabric layer 19 may be stitched into the mattress cover in an end region adjacent the longitudinal edge of the cover for additional support and an edge 21 of the tension web 16 stitched or otherwise attached to the reinforced fabric layer. In the embodiment shown the reinforcing fabric is approximately 4 inches in width. The retaining bar 17 is placed well inboard from a longitudinal edge 23 of the foot support member 13 and is captured in the tubular fabric tension web 16 as will be described in greater detail subsequently. In the embodiment shown, the brackets 18 for mounting of the retaining bar 17 are positioned approximately 6.5 inches from the longitudinal edge of the foot support member 13 to allow sheets or other bedding to be tucked under the mattress at the longitudinal edge 23. The width of the tubular fabric tension web 16 extends across only a center portion of the overall width of the foot support member inset from the lateral edges 24 of the bed. For the embodiment shown a 30 inch width is employed for a double bed having an overall width of approximately 60 inches.

Figure 3A:
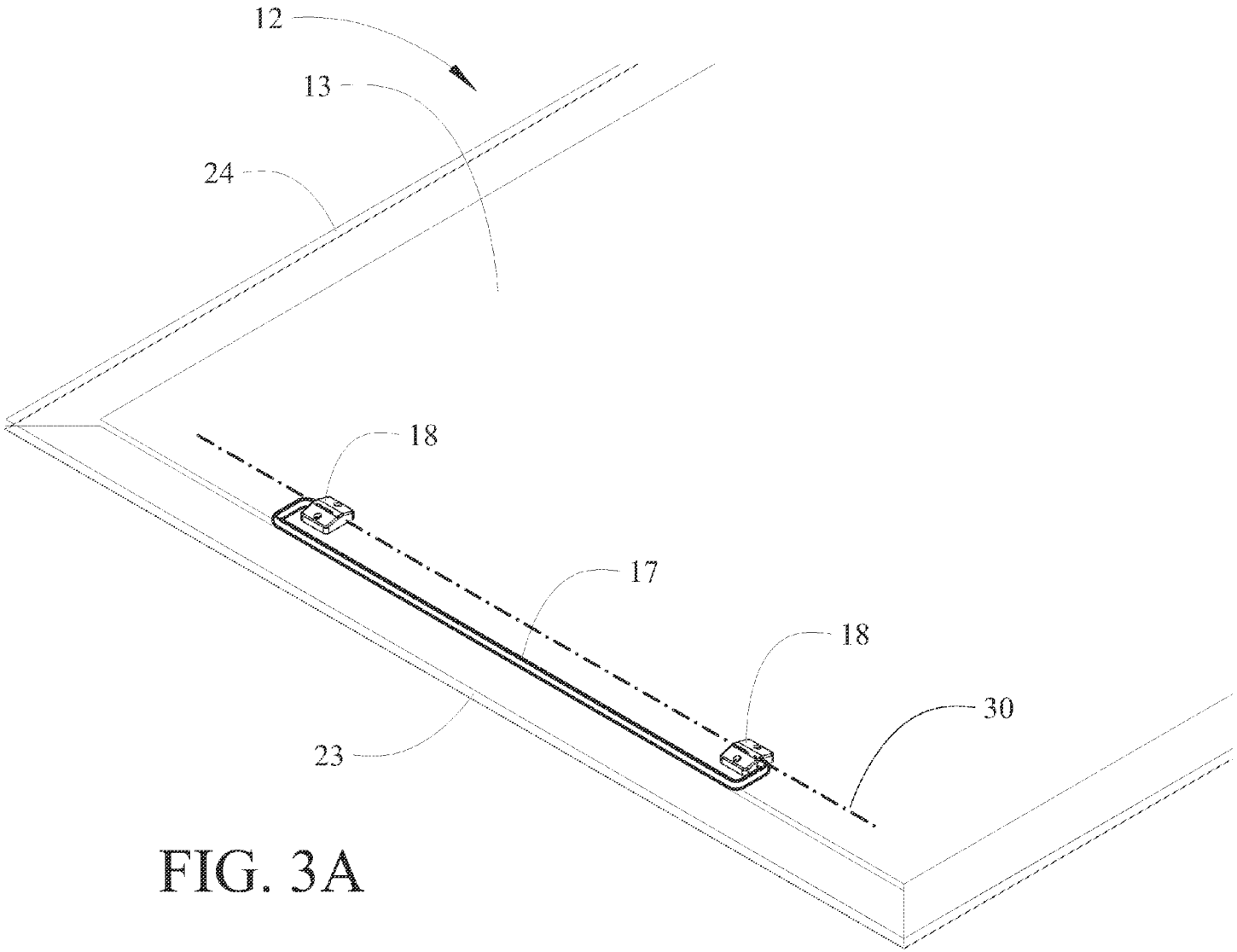
FIG. 3A is an isometric top view of the retainer bar as mounted to the foot support member.
Figure 3B:
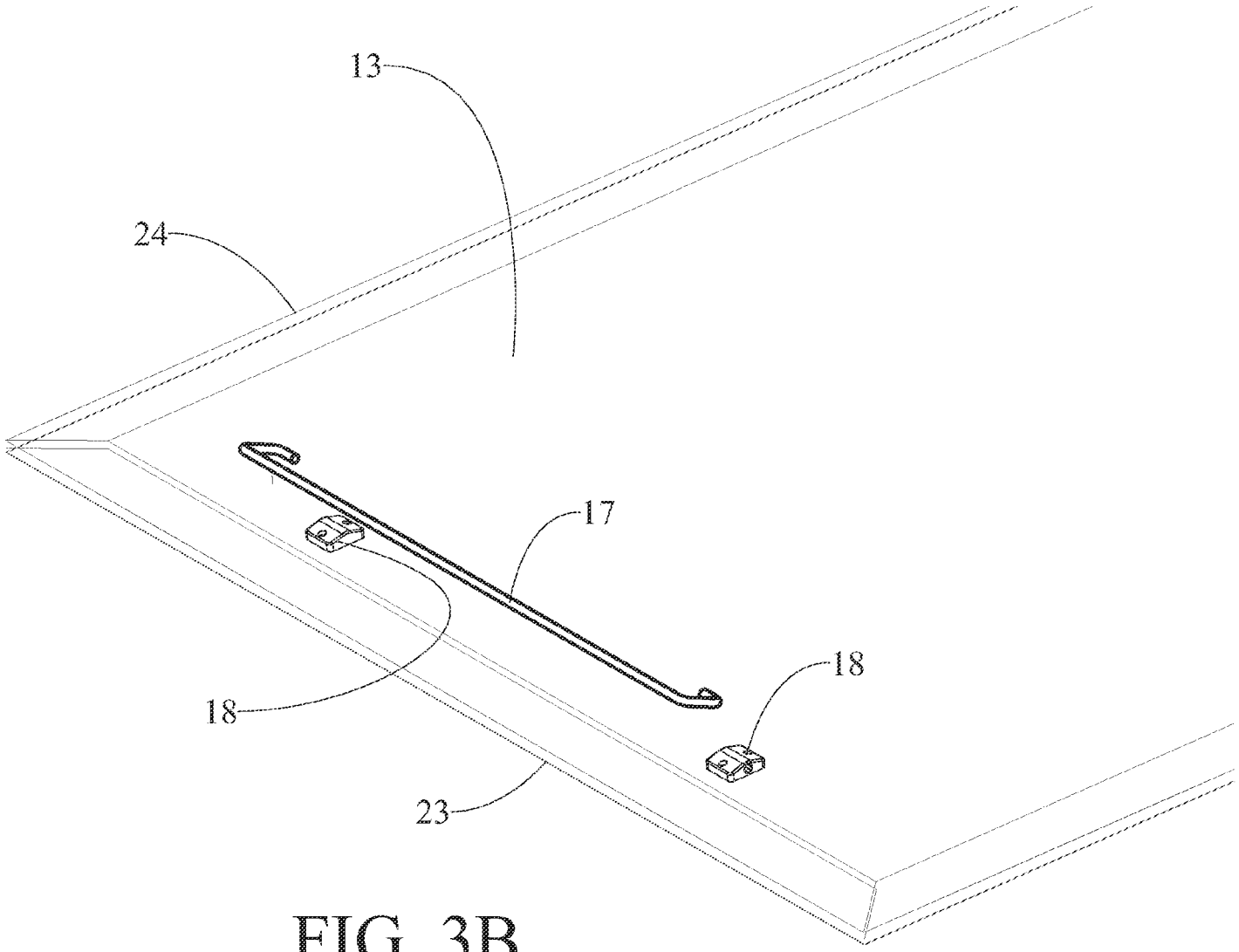
FIG. 3B is an isometric top view of the retainer bar removed from the brackets on the foot support member.

As shown in FIGS. 3A and 3B, the retaining bar 17 is substantially "C" shaped with open ends received in the brackets 18. This configuration allows rotation of the retaining bar around an axis 30. The bar is sufficiently resilient to be flexed allowing the ends to be inserted in receiving bores in the brackets and retained when the bar is unflexed. Removed from the brackets as shown in FIG. 3B, the bar 17 may be inserted into the tubular fabric retaining web 16 prior to insertion into the brackets 18.

Figure 4A:
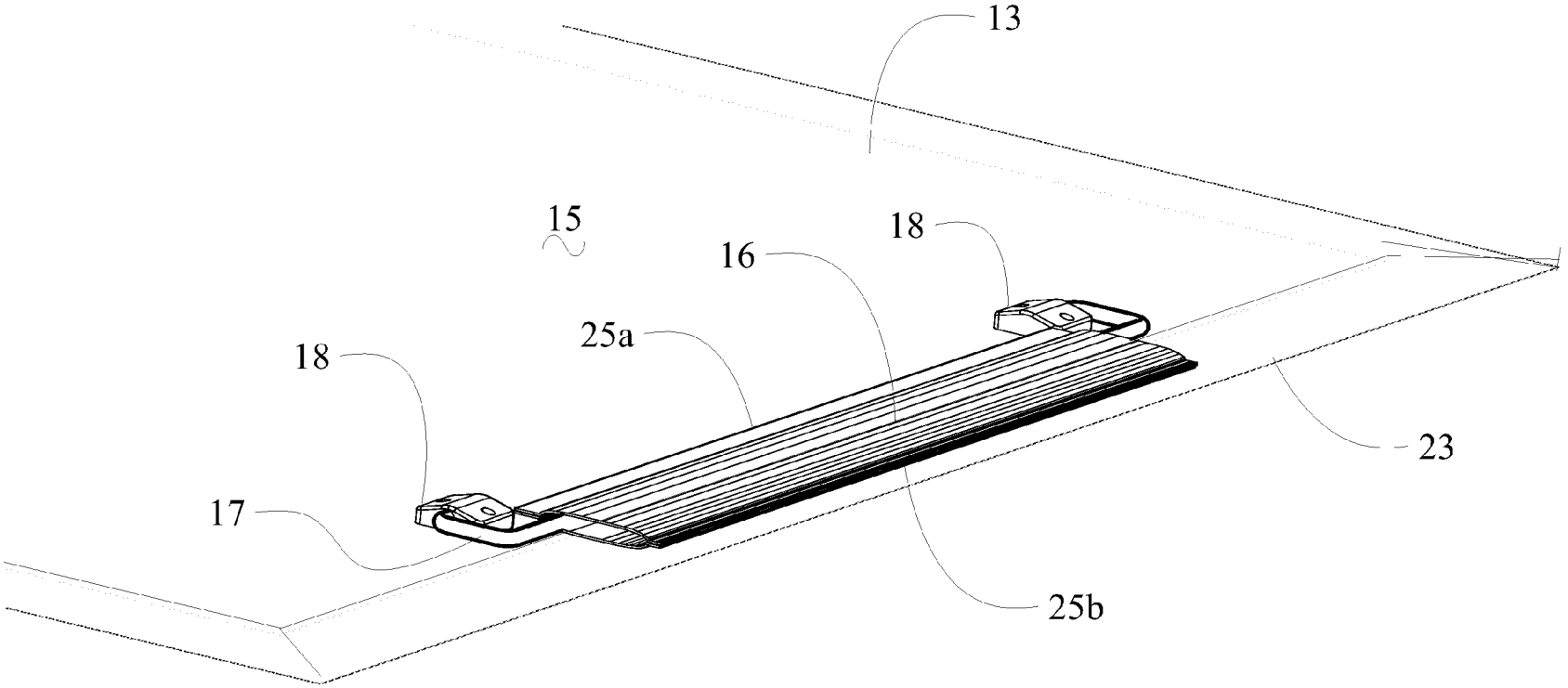
FIG. 4A is an isometric top view of the retainer bar as mounted to the foot support member with the tubular fabric element installed.
Figure 4B:
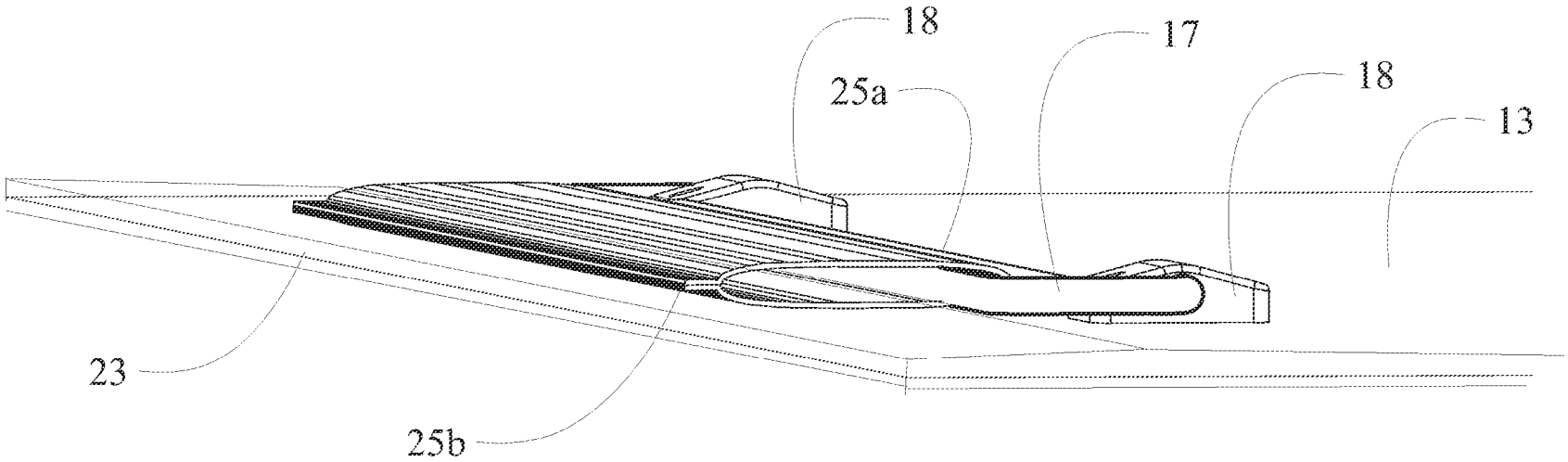
FIG. 4B is an alternative pictorial top view the retainer bar as mounted to the foot support member with the tubular fabric element installed; and, FIG. 5 is a side view demonstrating incorporation of the embodiments described for both a head portion and a foot portion of the articulating bed.

When inserted, the bar 17 and tubular fabric retaining web 16 are joined as shown in FIGS. 4A and 4B (mattress cover 20 not shown for clarity). Reinforced stitched zones 25*a* and 25*b* may be employed in the tubular fabric tension web 16 to provide additional strength for tensioning by the bar 16 (zone 25*a*) and for stitching to the mattress cover 22 (zone 25*b*).

Figure 5:
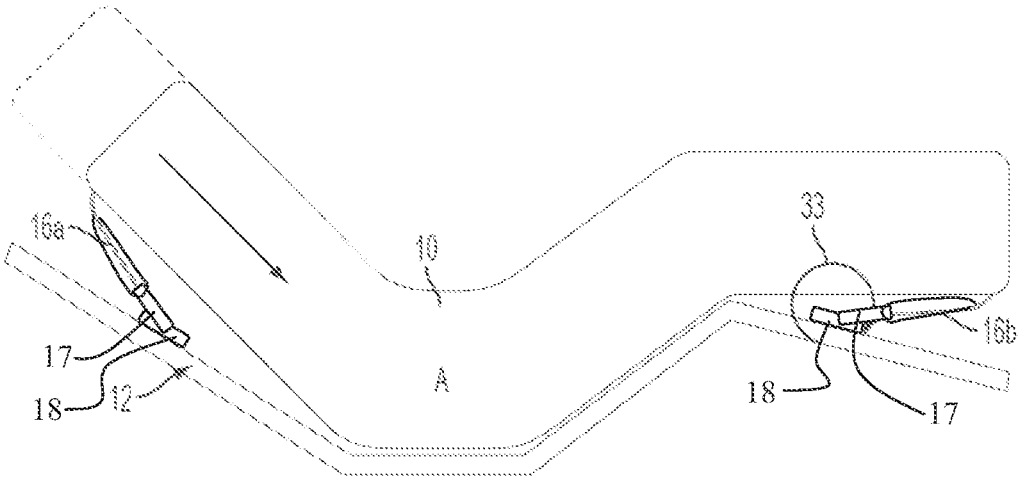

While intended primarily for use at the foot of the be, as shown in FIG. 5, placing paired tubular tension webs 16*a* and 16*b* associated with edges of the articulating support structure at the head and foot of the bed provides longitudinal tension restraint preventing lifting of companion edges on both the head and foot of the mattress as well as bridging in the seat section when respective sections are articulated (the lifting effect is shown exaggerated in the drawings while in practice, the mattress is restrained firmly against the surface with opposing restraints at the head and foot preventing bridging of the mattress which would result in upward motion of the mattress as indicated by the dotted line). Placement of the associated brackets 18 for securing the bars 17 and associated tubular tension webs to the top surface 15 of support structure 12 is as previously described. Use of the tension webs in attachment to the mating elements creates tension in the mated system which results in a moment 33 about the axis 30 to urge the mattress head or foot into contact with the respective support surface.

For larger bed and mattress systems, lateral restraint for the mattress may also be desired. The structure associated with the embodiments described above may also be applied along the lateral extents of the mattress to restrain the mattress from lifting.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A mattress retention system for adjustable beds comprising:

a tubular fabric tension web attached at an edge to a bottom surface of a mattress cover proximate a longitudinal edge to be restrained, said tension web extending across a center portion of an overall width of the mattress cover inset from the lateral edges, said tension web having a retaining bar received therethrough; and, brackets on a support section of an articulating support structure to receive ends of the retaining bar, said brackets inset from the longitudinal edge.

2. The mattress retention system as defined in claim 1 wherein the tubular fabric tension web is attached to the mattress cover proximate a surrounding zipper.

3. The mattress retention system as defined in claim 2 wherein the tubular fabric tension web incorporates reinforced stitched zones.

4. The mattress retention system as defined in claim 1 wherein the retaining bar is substantially C shaped.

5. The mattress retention system as defined in claim 1 wherein the longitudinal edge is at the mattress foot.

6. The mattress retention system as defined in claim 1 wherein the longitudinal edge is at the mattress head.

7. The mattress retention system as defined in claim 1 wherein the mattress cover incorporates a reinforced fabric layer stitched into the mattress cover in an end region adjacent the edge of the cover for additional support.

8. An adjustable bed comprising:

a support structure having at least one articulating element with a top surface, a longitudinal edge and lateral edges;

a mattress received on the support structure on the top surface of the articulating element and having adjacent longitudinal and lateral edges;

at least one tubular fabric tension web attached at an edge to a bottom surface of a mattress cover proximate a longitudinal edge to be restrained, said tension web extending across a center portion of an overall width of the mattress cover inset from the lateral edges, said tension web having a retaining bar received therethrough; and, brackets on the top surface to receive ends of the retaining bar, said brackets inset from the edge to be restrained.

9. The mattress retention system as defined in claim 8 wherein the tubular fabric tension web is attached to the mattress cover proximate a surrounding zipper.

10. The mattress retention system as defined in claim 9 wherein the tubular fabric tension web incorporates reinforced stitched zones.

11. The mattress retention system as defined in claim 8 wherein the retaining bar is substantially C shaped.

12. The mattress retention system as defined in claim 8 wherein the longitudinal edge is at the mattress foot.

13. The mattress retention system as defined in claim 8 wherein the longitudinal edge is at the mattress head.

* * * * *